US007255091B2

(12) United States Patent
Barnes et al.

(10) Patent No.: US 7,255,091 B2
(45) Date of Patent: Aug. 14, 2007

(54) FUEL INJECTOR CONTROL SYSTEM AND METHOD

(75) Inventors: Travis E. Barnes, Metamora, IL (US); Rammohan Sankar, Peoria, IL (US); Daniel Yongxiang Li, Peoria, IL (US)

(73) Assignee: Caterpillar, Inc., Peoria, IL (US)

( * ) Notice: Subject to any disclaimer, the term of this patent is extended or adjusted under 35 U.S.C. 154(b) by 24 days.

(21) Appl. No.: 11/139,685

(22) Filed: May 31, 2005

(65) Prior Publication Data

US 2006/0266335 A1 Nov. 30, 2006

(51) Int. Cl.
*F02M 37/04* (2006.01)
*F02M 37/08* (2006.01)

(52) U.S. Cl. ..... 123/506

(58) Field of Classification Search ..... 123/506, 123/500, 501, 502, 503, 504, 472, 473, 478, 123/480, 467, 446; 239/88–91
See application file for complete search history.

(56) References Cited

U.S. PATENT DOCUMENTS

| | | | |
|---|---|---|---|
| 5,893,516 | A | 4/1999 | Harcombe et al. |
| 5,915,623 | A | 6/1999 | Knight et al. |
| 5,915,624 | A | 6/1999 | Coldren et al. |
| 5,934,559 | A | 8/1999 | Coldren et al. |
| 5,939,963 | A | 8/1999 | Harcombe |
| 5,947,380 | A | 9/1999 | Coldren et al. |
| 5,971,300 | A | 10/1999 | Coldren et al. |
| 5,975,437 | A | 11/1999 | Streicher et al. |
| 5,984,208 | A | 11/1999 | Martin et al. |
| 5,986,871 | A | 11/1999 | Forck et al. |
| 6,000,638 | A | 12/1999 | Martin |
| 6,113,014 | A | 9/2000 | Coldren et al. |
| 6,167,869 | B1 | 1/2001 | Martin et al. |
| 6,457,457 | B1 | 10/2002 | Harcombe |
| 6,561,164 | B1 | 5/2003 | Mollin |
| 6,725,147 | B2 | 4/2004 | Mollin |
| 6,856,222 | B1 | 2/2005 | Forck |
| 2002/0162542 | A1 | 11/2002 | Dutart et al. |
| 2003/0111061 | A1 * | 6/2003 | Coldren et al. ..... 123/514 |

(Continued)

FOREIGN PATENT DOCUMENTS

DE 41 18 236 A1 12/1991

(Continued)

*Primary Examiner*—Mahmoud Gimie
(74) *Attorney, Agent, or Firm*—Finnegan, Henderson, Farabow, Garrett & Dunner

(57) ABSTRACT

A fuel injector for an internal combustion engine is disclosed. The fuel injector has a plunger, an electronically controlled check valve, and a controller in communication with the electronically controlled check valve. The controller is configured to receive a indication of a desired start of injection timing relative to an angular position of a crankshaft of the engine, and a desired injection quantity. The controller is also configured to determine a displacement of the plunger based on an angular position of the crankshaft; to determine a start of current for the electronically controlled check valve relative to plunger displacement that results in the desired start of injection timing, and to determine an end of current for the electronically controlled check valve relative to plunger displacement that results in the desired injection quantity. The controller is further configured to affect the determined start and end of current for the electronically controlled check valve.

22 Claims, 4 Drawing Sheets

U.S. PATENT DOCUMENTS

2004/0163626 A1 8/2004 Stockner et al.

FOREIGN PATENT DOCUMENTS

DE 101 55 674 A1 5/2003
EP 0 987 430 A 3/2000
EP 0 987 431 A 3/2000
EP 1 211 411 A 6/2002
EP 1 236 885 A 9/2002

* cited by examiner

FILL

PRESSURIZE

BEGIN INJECTION AT VOP

END INJECTION

SPILL

FUEL INJECTOR CONTROL SYSTEM AND METHOD

TECHNICAL FIELD

The present disclosure is directed to a control system and method and, more particularly, to a system and method for controlling operation of a fuel injector.

BACKGROUND

Fuel injected engines use injectors to introduce fuel into the combustion chambers of the engine. The injectors may be hydraulically or mechanically actuated with mechanical, hydraulic, or electrical control of fuel delivery. For example, a mechanically-actuated, electronically-controlled fuel injector includes a plunger movable by a cam-driven rocker arm to pressurize fuel within a bore of the injector. One or more electronic devices disposed within the injector are then actuated to deliver the pressurized fuel into the combustion chambers of the engine at one or more predetermined conditions.

One example of a mechanically-actuated, electronically-controlled fuel injector is described in U.S. Pat. No. 6,856,222 (the '222 patent) issued to Forck on Feb. 15, 2005. The '222 patent describes a fuel injector having a spring-biased, solenoid-controlled spill valve and a spring-biased, solenoid-controlled injection control valve. Both the spill valve and the injection control valve are associated with a cam-driven plunger and a control chamber of a valve needle. As the plunger is initially forced by a cam into a bore within the fuel injector, fuel within the bore flows past the spill valve to a low pressure drain. When the spill valve is electrically closed during further movement of the plunger into the bore, pressure within the bore builds. When an injection of fuel is desired, the injection control valve is electronically moved to connect the control chamber to the low pressure drain, thus permitting movement of the valve needle away from a seating to commence injection. To end injection, the injection control valve disconnects the control chamber from the low pressure drain to return the valve needle to its seating. The time during which the valve needle is away from its seating determines the quantity of fuel injected.

Although the injector of the '222 patent may sufficiently inject fuel into the combustion chambers of an engine, it may lack precise injection control. In particular, fuel delivery control based on an elapsed period of injection duration may be deficient in repeatability and accuracy because of injector-to-injector variation and varying operational conditions of the engine such as speed, load, temperature, viscosity, and other known operational engine conditions. In addition, systems implementing injector control based on time durations and general lookup tables may only be accurate at limited calibrated operational conditions of the engine and may loose repeatability and precision over time as the components of the fuel system wear.

The control method of the present disclosure solves one or more of the problems set forth above.

SUMMARY OF THE INVENTION

One aspect of the present disclosure is directed to a fuel injector for an internal combustion engine having a crankshaft. The fuel injector includes a cam-driven plunger reciprocatingly disposed within a bore to pressurize fuel within the bore, a nozzle member having a tip end with at least one orifice, and a valve needle having a base end and tip end. The valve needle is disposed within the nozzle member and movable against a spring bias to allow a flow of pressurized fuel through the at least one orifice. The fuel injector also includes an electronically controlled check valve in fluid communication with the bore and the base end of the valve needle. The electronically controlled check valve is movable between a first position at which the bore is fluidly communicated with the base end of the valve needle, and a second position at which the base end of the valve needle is fluidly communicated with a drain. The fuel injector further includes a controller in communication with the electronically controlled check valve. The controller is configured to receive an indication of a desired start of injection timing relative to an angular position of the crankshaft, and a desired injection quantity. The controller is also configured to determine a displacement position of the plunger corresponding to the angular position of the crankshaft, to determine a start of current for the electronically controlled check valve relative to plunger displacement within the bore that results in the desired start of injection timing, and to determine an end of current for the electronically controlled check valve relative to plunger displacement within the bore that results in the desired injection quantity. The controller is further configured to affect the determined start and end of current for the electronically controlled check valve.

Another aspect of the present disclosure is directed to a method of operating a fuel injector for an internal combustion engine having a crankshaft. The method includes cammingly driving a plunger within a bore to pressurize fuel and directing the pressurized fuel to at least one orifice of a nozzle member and to the base end of a valve needle disposed within the nozzle member. The method also includes receiving an indication of a desired start of injection timing relative to an angular position of the crankshaft and a desired injection quantity. The method further includes electronically moving a check valve to drain the pressurized fuel from the base end of the valve needle to allow the pressurized fuel to flow through the at least one orifice at the desired injection timing in the amount of the desired injection quantity. Electronically moving the check valve includes determining a start of current for the electronically controlled check valve relative to plunger displacement within the bore that results in the desired start of injection timing, determining an end of current for the electronically controlled check valve relative to plunger displacement within the bore that results in the desired injection quantity, and affecting the determined start and end of current for the electronically controlled check valve.

DETAILED DESCRIPTION

Figure 1:
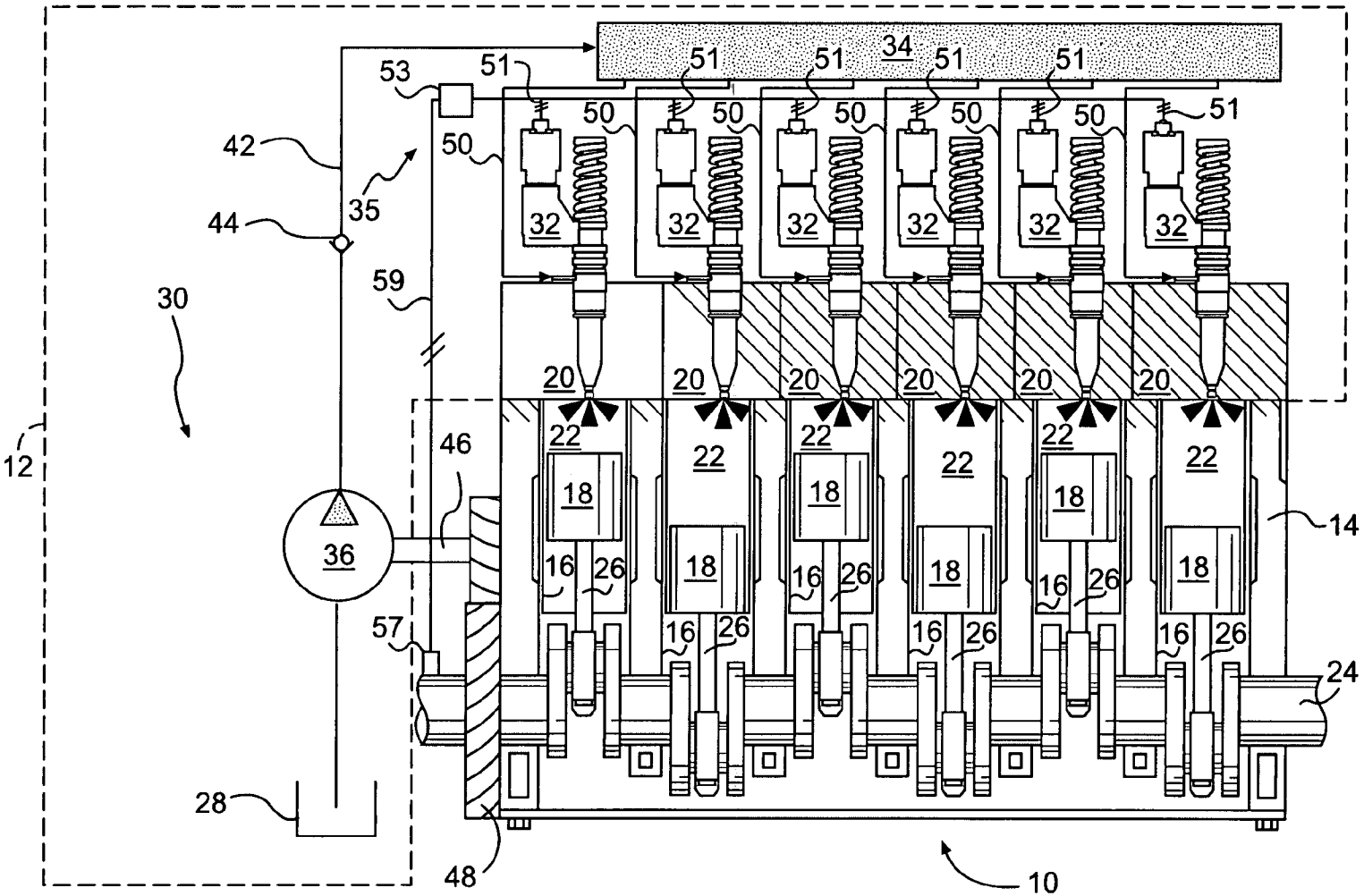
FIG. 1 is a schematic and diagrammatic illustration of an exemplary disclosed fuel system.

FIG. 1 illustrates an engine 10 and an exemplary embodiment of a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, a fuel pumping arrangement 30 configured to pressurize the fuel and direct the pressurized fuel to a plurality of fuel injectors 32 by way of a manifold 34, and a control system 35.

Fuel pumping arrangement 30 may include one or more pumping devices that function to increase the pressure of the fuel and direct one or more pressurized streams of fuel to manifold 34. In one example, fuel pumping arrangement 30 includes a low pressure source 36. Low pressure source 36 may embody a transfer pump configured to provide low pressure feed to manifold 34 via a fuel line 42. A check valve 44 may be disposed within fuel line 42 to provide for one-directional flow of fuel from fuel pumping arrangement 30 to manifold 34. It is contemplated that fuel pumping arrangement 30 may include additional and/or different components than those listed above such as, for example, a high pressure source disposed in series with low pressure source 36.

Low pressure source 36 may be operably connected to engine 10 and driven by crankshaft 24. Low pressure source 36 may be connected with crankshaft 24 in any manner readily apparent to one skilled in the art where a rotation of crankshaft 24 will result in a corresponding rotation of a pump drive shaft. For example, a pump driveshaft 46 of low pressure source 36 is shown in FIG. 1 as being connected to crankshaft 24 through a gear train 48. It is contemplated, however, that low pressure source 36 may alternatively be driven electrically, hydraulically, pneumatically, or in any other appropriate manner.

Fuel injectors 32 may be disposed within cylinder heads 20 and connected to manifold 34 by way of a plurality of fuel lines 50. Each fuel injector 32 may be operable to inject an amount of pressurized fuel into an associated combustion chamber 22 at predetermined timings, fuel pressures, and quantities. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration. In order to accomplish these specific injection events, engine 10 may request an injection of fuel from control system 35 at a specific start of injection (SOI) timing, a specific start of injection pressure, a specific end of injection (EOI) pressure, and/or may request a specific quantity of injected fuel.

Control system 35 may control operation of each fuel injector 32 in response to one or more inputs. In particular, control system 35 may include a controller 53 that communicates with fuel injectors 32 by way of a plurality of communication lines 51 and with a sensor 57 by way of a communication line 59. Controller 53 may be configured to control a fuel injection timing, pressure, and amount by applying a determined current waveform or sequence of determined current waveforms to each fuel injector 32 based on input from sensor 57.

The timing of the applied current wave form or sequence of waveforms may be facilitated by monitoring an angular position of crankshaft 24 via sensor 57. In particular, sensor 57 may embody a magnetic pickup-type sensor configured to sense an angular position, velocity, and/or acceleration of crankshaft 24. From the sensed angular information of crankshaft 24 and known geometric relationships, controller 53 may be able to calculate the position of one or more components of fuel injector 32 that are operably driven by crankshaft 24 and thereby control the injection timing, pressure, and quantity as a function of the calculated position.

Controller 53 may embody a single microprocessor or multiple microprocessors that include a means for controlling an operation of fuel injector 32. Numerous commercially available microprocessors can be configured to perform the functions of controller 53. It should be appreciated that controller 53 could readily embody a general work machine or engine microprocessor capable of controlling numerous work machine or engine functions. Controller 53 may include all the components required to run an application such as, for example, a memory, a secondary storage device, and a processor, such as a central processing unit or any other means known in the art for controlling fuel injectors 32. Various other known circuits may be associated with controller 53, including power supply circuitry, signal-conditioning circuitry, solenoid driver circuitry, communication circuitry, and other appropriate circuitry.

Figure 2:
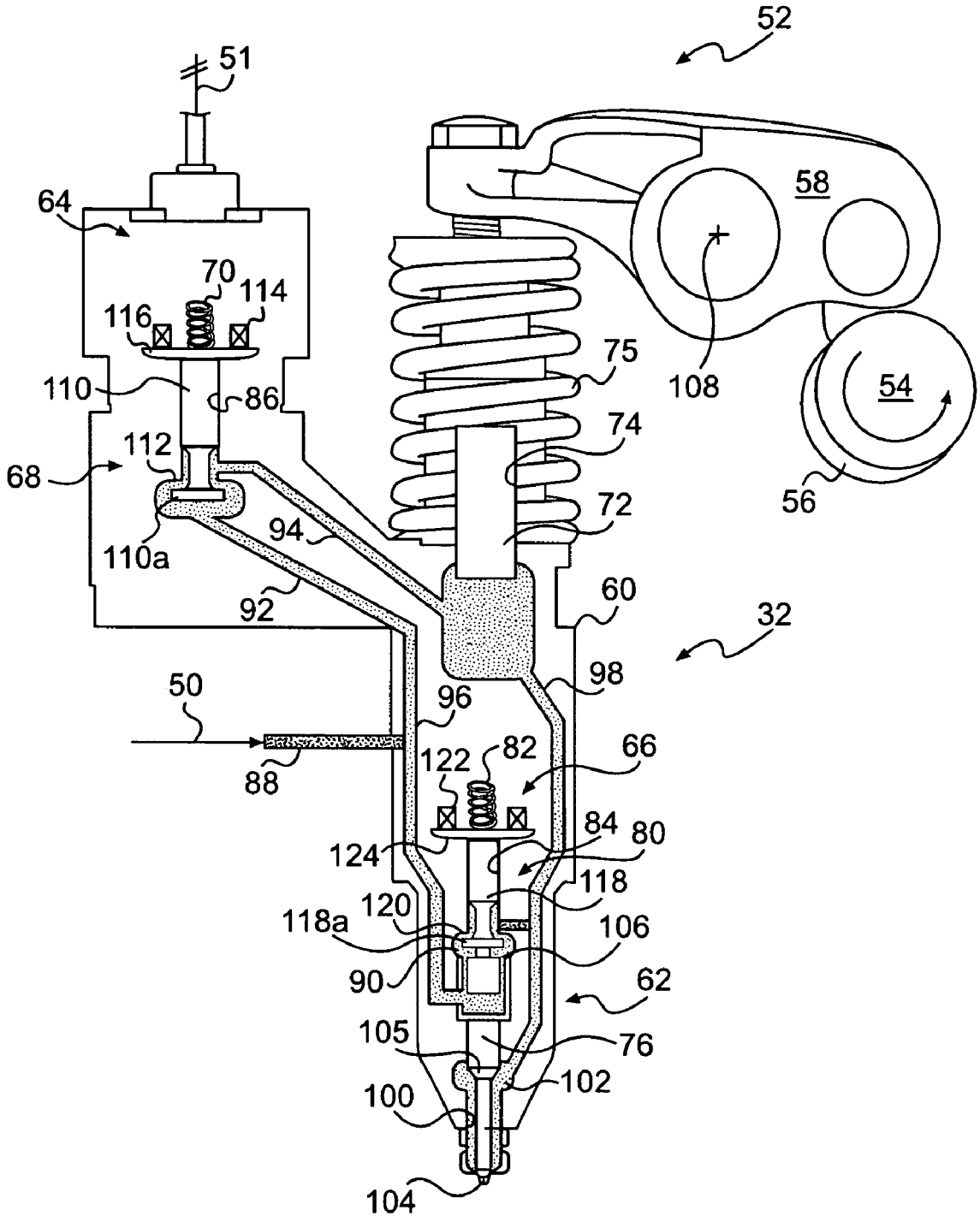
FIG. 2 is a cut-away view illustration of an exemplary disclosed fuel injector for the fuel system of FIG. 1.

As illustrated in FIG. 2, each fuel injector 32 may embody a mechanically-operated pump-type unit fuel injector. Specifically, each fuel injector may be driven by a cam arrangement 52 to selectively pressurize fuel within fuel injector 32 to a desired pressure level. Cam arrangement 52 may include a cam 54 operably connected to crankshaft 24 such that a rotation of crankshaft 24 results in a corresponding rotation of cam 54. For example, cam arrangement 52 may be connected with crankshaft 24 through a gear train (not shown), through a chain and sprocket arrangement (not shown), or in any other suitable manner. As will be described in greater detail below, during rotation of cam 54, a lobe 56 of cam 54 may periodically drive a pumping action of fuel injector 32 via a pivoting rocker arm 58. It is contemplated that the pumping action of fuel injector 32 may alternatively be driven directly by lobe 56 without the use of rocker arm 58, or that a pushrod (not shown) may be disposed between rocker arm 58 and fuel injector 32.

Fuel injector 32 may include multiple components that interact to pressurize and inject fuel into combustion chamber 22 of engine 10 in response to the driving motion of cam arrangement 52. In particular, each fuel injector 32 may include a injector body 60 having a nozzle portion 62, a plunger 72 disposed within a bore 74 of injector body 60, a plunger spring 75, a valve needle 76, a valve needle spring (not shown), a spill valve 68, a spill valve spring 70, a first electrical actuator 64, a direct operated check (DOC) valve 80, a DOC spring 82, and a second electrical actuator 66. It is contemplated that additional or different components may be included within fuel injector 32 such as, for example, restricted orifices, pressure-balancing passageways, accumulators, and other injector components known in the art.

Injector body 60 may embody a generally cylindrical member configured for assembly within cylinder head 20 and having one or more passageways. Specifically, injector body 60 may include bore 74 configured to receive plunger 72, a bore 84 configured to receive DOC valve 80, a bore 86 configured to receive spill valve 68, and a control chamber 90. Injector body 60 may also include a fuel supply/return line 88 in communication with bores 86, 74, 84, control chamber 90, and nozzle portion 62 via fluid passageways 92, 94, 96, and 98, respectively. Control chamber 90 may be in direct communication with valve needle 76 and selectively drained of or supplied with pressurized fuel to affect motion of valve needle 76. It is contemplated that injector body 60 may alternatively embody a multi-member element having one or more housing members, one or more guide members, and any other suitable number and/or type of structural members.

Nozzle portion 62 may likewise embody a cylindrical member having a central bore 100 and a pressure chamber 102. Central bore 100 may be configured to receive valve needle 76. Pressure chamber 102 may hold pressurized fuel supplied from fluid passageway 98 in anticipation of an injection event. Nozzle portion 62 may also include one or more orifices 104 to allow the pressurized fuel to flow from pressure chamber 102 through central bore 100 into combustion chambers 22 of engine 10.

Plunger 72 may be slidingly disposed within bore 74 and movable by rocker arm 58 to pressurize fuel within bore 74. Specifically, as lobe 56 pivots rocker arm 58 about a pivot point 108, an end of rocker arm 58 opposite lobe 56 may urge plunger 72 against the bias of plunger spring 75 into bore 74, thereby displacing and pressurizing the fuel within bore 74. The fuel pressurized by plunger 72 may be selectively directed through fluid passageways 92–98 to spill valve 68, DOC valve 80, control chamber 90, supply/return line 88, and pressure chamber 102 associated with valve needle 76. As lobe 56 rotates away from rocker arm 58, plunger spring 75 may return plunger 72 upward out of bore 74, thereby drawing fuel back into bore 74.

Valve needle 76 may be an elongated cylindrical member that is slidingly disposed within central bore 100 of nozzle portion 62. Valve needle 76 may be axially movable between a first position at which a tip end of valve needle 76 blocks a flow of fuel through orifice 104, and a second position at which orifice 104 is open to allow a flow of fuel into combustion chamber 22. It is contemplated that valve needle 76 may be a multi-member element having a needle member and a piston member, or a single integral element.

Valve needle 76 may have multiple driving hydraulic surfaces. For example, valve needle 76 may include a hydraulic surface 105 located at a base end of valve needle 76 to drive valve needle 76 with the bias of the valve needle spring toward an orifice-blocking position when acted upon by pressurized fuel. Valve needle 76 may also include a hydraulic surface 106 that opposes the bias of the valve needle spring to drive valve needle 76 in the opposite direction toward a second or orifice-opening position when acted upon by pressurized fuel. When both hydraulic surfaces 105 and 106 are exposed to substantially the same fluid pressures, the force exerted by the valve needle spring on valve needle 76 may be sufficient to move valve needle 76 to and hold valve needle 76 in the orifice-blocking position.

Spill valve 68 may be disposed between fluid passageways 92 and 94 and configured to selectively allow fuel displaced from bore 74 to flow through fluid passageway 92 to supply/return line 88 where the pressurized fuel may exit fuel injector 32. Specifically, spill valve 68 may include a valve element 110 connected to first electrical actuator 64. Valve element 110 may have a region of enlarged diameter 110*a*, which is engageable with a valve seat 112 to selectively block the flow of pressurized fuel from fluid passageway 94 to fluid passageway 92. Movement of region 10*a* away from valve seat 112 may allow the pressurized fuel to flow from fluid passageway 94 to fluid passageway 92 and exit fuel injector 32 via supply/return line 88. When fuel forced from bore 74 is allowed to exit fuel injector 32 via supply/return line 88, the buildup of pressure within fuel injector 32 due to inward displacement of plunger 72 may be minimal. However, when the fuel is blocked from supply/return line 88, the displacement of fuel from bore 74 may result in an increase of pressure within fuel injector 32 to about 30,000 psi. Spill valve spring 70 may be situated to bias spill valve 68 toward the flow passing position.

First electrical actuator 64 may include a solenoid 114 and armature 116 for controlling motion of spill valve 68. In particular, solenoid 114 may include windings of a suitable shape through which current may flow to establish a magnetic field such that, when energized, armature 116 may be drawn toward solenoid 114. Armature 116 may be fixedly connected to valve element 110 to move region 110*a* of valve element 110 against the bias of spill valve spring 70 and into engagement with valve seat 112.

DOC valve 80 may be disposed between fluid passageway 98 and control chamber 90, and configured to selectively block fuel displaced from bore 74 from flowing to control chamber 90, thereby facilitating fuel injection through orifice 104. Specifically, DOC valve 80 may include a valve element 118 connected to second electrical actuator 66. Valve element 118 may have a region of enlarged diameter 118*a*, which is engageable with a valve seat 120 to selectively block the flow of pressurized fuel from control chamber 90. When the pressurized fuel from fluid passageway 98 is blocked from control chamber 90, an imbalance of force on valve needle 76 may be generated that causes valve needle 76 to move against the spring bias toward the flow-passing position. Disengagement of region 118*a* from valve seat 120 may allow the pressurized fuel to flow from fluid passageway 98 into control chamber 90, the influx of pressurized fluid thereby returning valve needle 76 to the injection-blocking position. DOC spring 82 may be situated to bias DOC valve 80 toward the flow passing position.

Second electrical actuator 66 may include a solenoid 122 and armature 124 for controlling motion of DOC valve 80. In particular, solenoid 122 may include windings of a suitable shape through which current may flow to establish a magnetic field such that, when energized, armature 124 may be drawn toward solenoid 122. Armature 124 may be fixedly connected to valve element 118 to move region 118*a* of valve element 118 against the bias of DOC spring 82 and into engagement with valve seat 120.

Figures 3A, 3B, 3C, 3D, 3E:
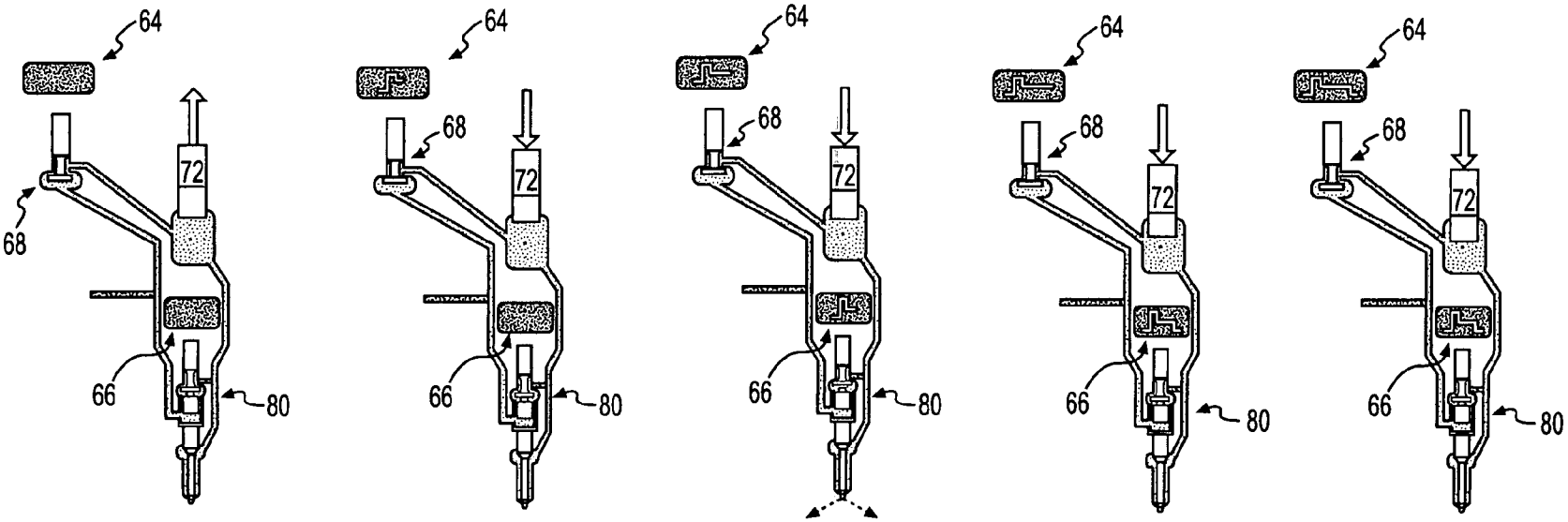
FIGS. 3A–3E are circuit diagrams for the fuel injector of FIG. 2.

In use, starting from the position illustrated in FIG. 3A, fuel injector 32 may fill with fuel when both of first and second electronic actuators 64, 66 are de-energized. In particular, as lobe 56 rotates away from rocker arm 58, plunger spring 75 may urge plunger 72 upward out of bore 74. The outward motion of plunger 72 from bore 74 may act to draw fuel from supply/return line 88 into bore 74 via fluid passageway 92, de-energized spill valve 68, and fluid passageway 94. During the filling operation of fuel injector 32, the forces caused by fluid pressures acting on the hydraulic surfaces of valve needle 76 may be substantially balanced, allowing for the valve needle spring to hold valve needle 76 in the orifice blocking position.

To pressurize the fuel within fuel injector 32, lobe 56 may rotate into engagement with rocker arm 58 to drive plunger 72 into bore 74, thereby displacing fuel from bore 74. If valve element 110 of spill valve 68 remains in the de-energized flow-passing position of FIG. 3A, the fuel displaced by plunger 72 may flow back through fluid passageways 94 and 92 to exit fuel injector 32 via supply/return line 88 without a substantial increase in pressure. However, if valve element 110 of spill valve is moved to the energized flow-blocking position during inward movement of plunger 72, as illustrated in FIG. 3B, the fuel displaced from bore 74 may be blocked from exiting fuel injector 32, thereby causing the pressure within fuel injector 32 to increase in proportion to the displacement of plunger 72. In order to prevent injection during pressurizing of the fuel within fuel injector 32, valve element 118 of DOC valve 80 may remain in the de-energized flow passing position to allow the buildup of pressure acting on hydraulic surface 106 to counteract the buildup of pressure acting on hydraulic surface 105, thereby allowing the valve needle spring to retain valve needle 76 in the orifice-blocking position.

When injection is desired, second electrical actuator 66 may be energized to draw valve element 118 of DOC valve 80 into engagement with valve seat 120, as illustrated in FIG. 3C. In this energized state, the fuel pressurized by the inward movement of plunger 72 may be blocked from hydraulic surface 106, but allowed to remain in contact with hydraulic surface 105. After valve element 118 moves to the flow-blocking position, the pressure of the fuel within control chamber 90 be lower than the pressure of the fuel acting against hydraulic surface 105. The imbalance of force created by the pressure differential on the hydraulic surfaces of valve needle 76 may act to move valve needle 76 against the bias of the valve needle spring, thereby opening orifice 104 and initiating injection of the pressurized fuel into combustion chamber 22. The time at which valve needle 76 moves away from orifice 104 may correspond to the start of injection timing of fuel injector 32. The displacement of plunger 72 that occurs after valve element 110 has moved to the flow-blocking position and before valve element 118 of DOC valve 80 has moved to the flow-blocking position may correspond to the pressure of the fuel at the start of injection.

To end injection, second electrical actuator 66 may be de-energized to allow valve element 118 of DOC valve 80 to return to the flow-passing position under the bias of DOC spring 82, as illustrated in FIG. 3D. As valve element 118 moves to the de-energized flow-passing position, high pressure fuel may be reintroduced into control chamber 90, thereby allowing the valve needle spring to urge valve needle 76 to the orifice-blocking position. As valve needle 76 reaches the orifice-blocking position, the injection of fuel into combustion chamber 22 may terminate. The displacement of plunger 72 that occurs after valve needle 76 has moved to the flow-passing position and before valve needle 76 returns to the flow-blocking position may correspond to the amount of fuel injected into combustion chamber 22. The time at which valve needle 76 returns to the orifice-blocking position may correspond to the EOI timing of fuel injector 32. The EOI pressure may be a function of plunger velocity and the opening area of orifice 104.

As illustrated in FIG. 3E, almost immediately following the movement of valve element 118 to the flow-passing position, valve element 110 may likewise be moved to the flow-passing position to relieve the pressure of the fuel within fuel injector 32 and reduce the load on low pressure source 36. It is contemplated that if a particular end of injection pressure is desired, valve element 110 may be moved to the flow passing position at a predetermined plunger displacement distance before valve element 118 is moved to the flow passing position to vary (i.e., reduce) the pressure of the fuel discharged through orifice 104.

A time lag may be associated with each of spill valve 68, DOC valve 80, and valve needle 76 between the time that current is applied to or removed from the windings of solenoids 114 and 122, and the time that the respective valve elements actually begin to move or reach their fully closed or open positions. Controller 53 may be configured to determine and apply a delay offset that accounts for this delay when closing or opening spill valve 68 and DOC valve 80.

Figure 4:
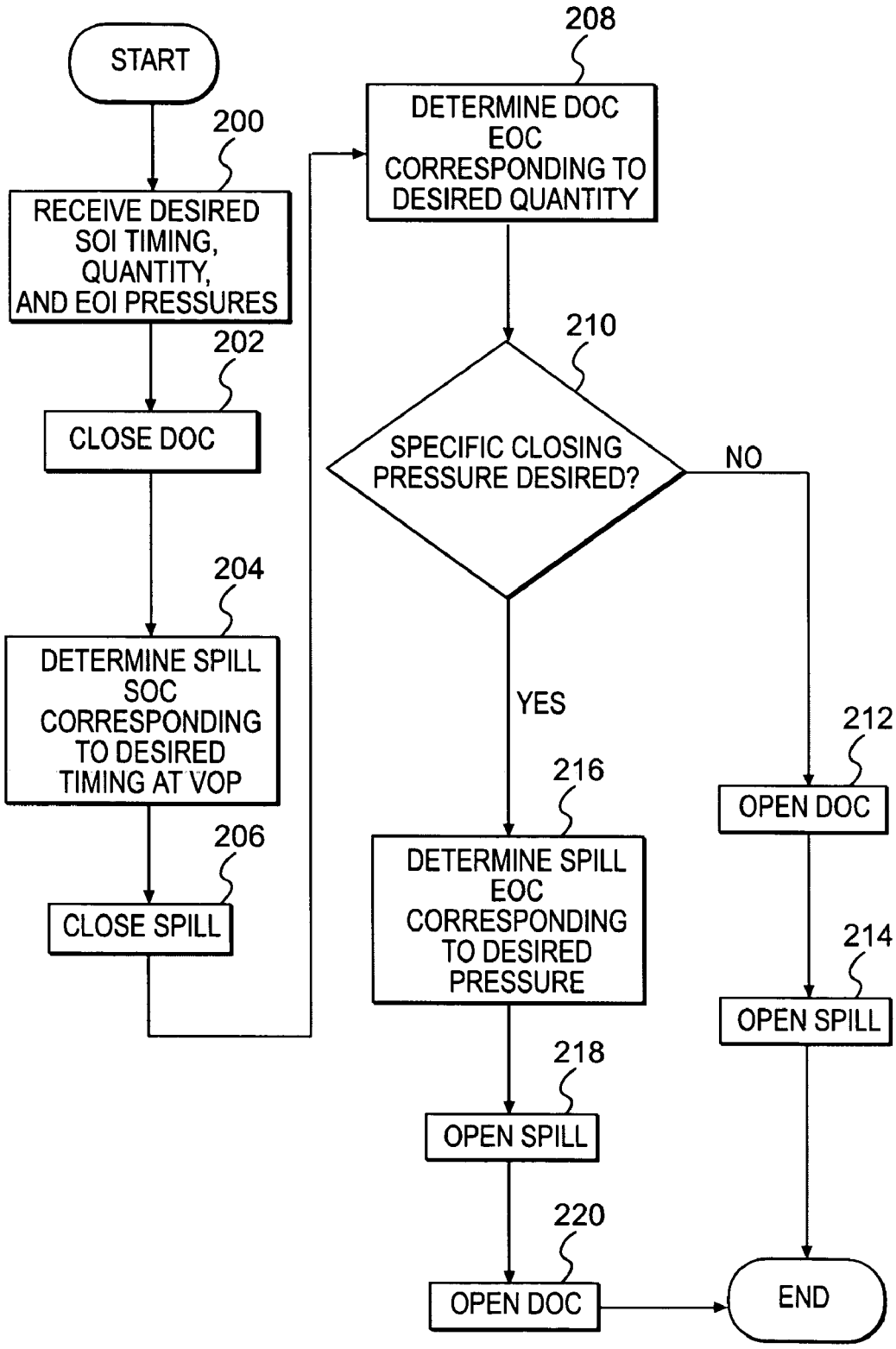
FIG. 4 is a flow chart depicting an exemplary method of operating the fuel injector of FIG. 2.

FIG. 4 illustrates an exemplary method of operating fuel injector 32. FIG. 4 will be discussed in detail below.

INDUSTRIAL APPLICABILITY

The fuel injector and control system of the present disclosure have wide applications in a variety of engine types including, for example, diesel engines, gasoline engines, and gaseous fuel-powered engines. The disclosed fuel injector and control system may be implemented into any engine where consistent, accurate fuel injector performance and efficiency are important. The operation of control system 35 will now be explained.

As indicated in the flow chart of FIG. 4, a controlled injection event may start by first receiving an indication of a desired start of injection (SOI) timing, a desired injection amount, a desired SOI pressure, and/or a desired end of injection (EOI) pressure (step 200). For example, engine 10 may request an SOI corresponding to a particular position of piston 18 within combustion chamber 22. Similarly, engine 10 may request a specific quantity of fuel, an SOI pressure, and/or an EOI pressure. These requested (e.g., desired) injection characteristics may be received by controller 53 in preparation for injection.

After receiving the desired fuel injection characteristics, controller 53 may determine a start of current (SOC) for second electrical actuator 66 that will move valve element 118 of DOC valve 80 to the closed position and initiate injection at the desired SOI timing (step 202). As indicated above, movement of valve element 118 of DOC valve 80 toward the energized flow-blocking position may cause movement of valve needle 76 toward the orifice-opening position, thereby initiating injection of fuel into combustion chamber 22. Controller 53 may determine the SOC by offsetting the desired SOI by system delays associated with DOC valve 80 and valve needle 76. Because movement of plunger 72 is directly related to an angular position of crankshaft 24, SOI and SOC may be received, determined, and expressed as functions of an angular position of crankshaft 24 and/or a displacement position of plunger 72 within bore 74.

Following the determination of the SOC for second electrical actuator 66, controller 53 may determine an SOC for first electrical actuator 64 associated with spill valve 68 that results in the desired pressure at SOI (step 204). As indicated above, the amount of displacement of plunger 72 into bore 74 after valve element 110 has been moved to the flow-blocking position and before valve element 118 has been moved to the flow-blocking position may correspond to the pressure at SOI. Controller 53 may be programmed with geometric relationships between an angular position of crankshaft 24, a stroke length and area of plunger 72, and/or a displacement position of plunger 72 within bore 74. From these geometric relationships and the desired SOI, controller 53 may calculate an SOC for first electrical actuator 64 in terms of crank angle and/or displacement of plunger 72. When plunger 72 moves through the displacement between SOC and SOI, fuel displaced from bore 74 may increase in pressure to the desired SOI pressure before valve needle 76 moves to inject the pressurized fuel into combustion chamber 22. Controller 53 may be further configured to account for delays associated with spill valve 68 when determining SOC of first electrical actuator 64.

Following the determination SOC for both first and second electrical actuators 64, 66 associated with spill and DOC valves 68, 80, controller 53 may monitor the angular position of crankshaft 24 via sensor 57 and energize first and second electrical actuators 64, 66 to close spill and DOC valves 68, 80 at the calculated angular or displacement SOC timings (steps 206, 208). After closing spill valve 68, the movement of plunger 72 through the determined displacement may build the pressure of the fuel within fuel injector 32 to the desired SOI pressure. After plunger 72 has reached the determined displacement position (or crankshaft 24 has rotated through the determined crank angle), DOC valve 80 may close to initiate the injection of fuel into combustion chamber 22 at the desired SOI timing.

Controller 53 may determine an EOI timing that corresponds with injection of the desired quantity of fuel. Using the geometric relationships described above, controller 53 may calculate the angle through which crankshaft 24 must turn and/or the displacement through which plunger 72 must move after SOI to push the desired amount of fuel through orifice 104. Controller 53 may then calculate an end of current (EOC) that account for delays associated with DOC valve 80 such that by the end of the injection at the determined EOI timing, the proper amount of fuel has been injected into combustion chamber 22 (step 210).

It may be possible for fuel injector 32 to inject multiple shots during the same injection event. In particular, before valve element 118 of DOC valve 80 moves to the open position to stop injection of fuel through orifice 104 and while valve element 110 of spill valve 68 remains in the flow-blocking condition, controller 53 may determine whether or not a subsequent shot has been requested within the same injection event (step 212). The step of determining whether or not multiple shots have been requested may alternatively be performed at any point before re-opening of spill valve 68. If a subsequent shot has been requested, controller 53 may affect the determined EOC for second electrical actuator 66 to open DOC valve 80 (step 214), calculate SOC for second electrical actuator 66 that initiates injection of the subsequent shot (step 216), initiate the calculated SOC to close DOC valve 80 an begin injection of the subsequent shot (step 208), and calculate EOC for second electrical actuator 66 that ends injection of the subsequent shot (step 210). SOI may be received from engine 10 or may be calculated to produce a desired pressure based on a displacement position of plunger 72 within bore 74. For a subsequent shot within a single injection event, only one of a desired start of injection timing and a desired start of injection pressure may be possible since valve element 110 of spill valve 68 is already in a flow-blocking position. SOC may be determined as a function of system delay associated with moving valve element 118 of DOC valve 80 to the closed position. EOI may be determined as a function of the desired injection quantity and the corresponding displacement of plunger 72. EOC may be determined that accounts for delay in moving valve element 118 to the open position. Controller 53 may initiate SOC and affect EOC for the subsequent shot (steps 208, 214) and continue in this manner until all desired subsequent shots of the single injection event have been injected or until plunger 72 has reached its full stroke within bore 74.

If a subsequent shot is not desired, controller 53 may determine whether or not a specific EOI pressure has been requested and operate differently according to the determination (step 218). Specifically, if a desired EOI pressure has not been requested, controller 53 may end injection by terminating the current supplied to second electrical actuator 66 at the calculated EOC timing (step 220) such that valve element 118 of DOC valve 80 moves to the open position in time for valve needle 76 to block orifice 104 at the EOI timing. In this situation, the EOI pressure is not specifically controlled, but rather dependent upon a displacement velocity of plunger 72 and an area of orifice 104. Immediately following the implementation of EOC for second electrical actuator 66, controller 53 may implement EOC for first electrical actuator 64 to move valve element 110 of spill valve 68 to the open position and relieve pressure within fuel injector 32 (step 222).

However, if a specific EOI pressure has been requested, EOC for valve element 110 of spill valve 68 may be calculated that results in the desired EOI pressure (step 224). In particular, if a particular EOI pressure is desired, valve element 110 of spill valve 68 may be moved to the open or flow-passing position to reduce the injection pressure within fuel injector 32 prior to the implementing the determined EOC associated with the opening of DOC valve 80 and the desired EOI (step 226). In this situation, the pressure of the fuel pushed through orifice 104 may be changed (i.e., reduced) prior to EOI. Controller 53 may again account for the time delay associated with first electrical actuator 64 and spill valve 68 by adjusting EOC accordingly. Following the implementation of the EOC associated with first electrical actuator 64 and spill valve 68, controller 53 may implement the EOC determined for DOC valve 80 to end the injection of fuel into combustion chamber 22 at the determined EOI (step 228).

Because controller 53 may calculate and implement SOC and EOC based on known geometric relationships and monitored component position rather than time durations and general lookup tables, accuracy and repeatability of the fuel injection event may be improved. In particular, because the geometric relationships and monitored component positions remain true at any given operational condition of engine 10, the method described above for determining and implementing SOC and EOC may repeatedly produce accurate results.

It will be apparent to those skilled in the art that various modifications and variations can be made to the fuel injector and control system of the present disclosure without departing from the scope of the disclosure. Other embodiments will be apparent to those skilled in the art from consideration of the specification and practice of the fuel injector and control system disclosed herein. It is intended that the specification and examples be considered as exemplary only, with a true scope of the disclosure being indicated by the following claims and their equivalents.

What is claimed is:

1. A fuel injector for an internal combustion engine having a crankshaft, comprising:

a cam-driven plunger reciprocatingly disposed within a bore to pressurize fuel within the bore;

a nozzle member having a tip end with at least one orifice;

a valve needle having a base end and tip end, being disposed within the nozzle member, and movable against a spring bias to allow a flow of pressurized fuel through the at least one orifice;

an electronically controlled check valve in fluid communication with the bore and the base end of the valve needle, the electronically controlled check valve movable between a first position at which the bore is fluidly communicated with the base end of the valve needle, and a second position at which the base end of the valve needle is fluidly communicated with a drain; and a controller in communication with the electronically controlled check valve, the controller configured to:

receive an indication of a desired start of injection timing relative to an angular position of the crankshaft, and a desired injection quantity;

determine a displacement position of the plunger corresponding to the angular position of the crankshaft;

determine a start of current for the electronically controlled check valve relative to plunger displacement within the bore that results in the desired start of injection timing;

determine an end of current for the electronically controlled check valve relative to plunger displacement within the bore that results in the desired injection quantity; and affect the determined start and end of current for the electronically controlled check valve.

2. The fuel injector of claim 1, further including an electronically controlled spill valve associated with the bore and movable to selectively connect the bore to a drain, wherein the controller is further configured to:

receive an indication of a desired start of injection pressure;

determine a start of current for the electronically controlled spill valve based on the desired start of injection pressure, the desired start of injection timing, and plunger displacement within the bore; and initiate the start of current determined for the electronically controlled spill valve.

3. The fuel injector of claim 2, wherein the start of current determined for the electronically controlled spill valve is initiated before the start of current determined for the electronically controlled check valve.

4. The fuel injector of claim 2, wherein the controller is further configured to:

receive an indication of a desired end of injection pressure;

determine an end of current for the electronically controlled spill valve based on the determined end of current for the electronically controlled check valve, the desired end of injection pressure, and the plunger displacement with the bore; and affect the end of current determined for the electronically controlled spill valve.

5. The fuel injector of claim 4, wherein the end of current determined for the electronically controlled spill valve is affected before the end of current determined for the electronically controlled check valve.

6. The fuel injection of claim 2, wherein the controller is further configured to affect an end of current for the electronically controlled spill valve substantially immediately following the affecting of the end of current determined for the electronically controlled check valve.

7. The fuel injector of claim 6, wherein the controller is further configured to:

receive an indication of a multi-shot injection event;

receive an indication of a desired start of injection timing for a subsequent injection within the multi-shot injection event;

receive an indication of a desired quantity of fuel for the subsequent injection;

determine a start of current for the electronically controlled check valve relative to plunger displacement within the bore that results in the desired start of injection timing for the subsequent injection;

determine an end of current for the electronically controlled check valve relative to plunger displacement within the bore that results in the desired quantity of the subsequent injection; and affect the start and end of current determined for the electronically controlled check valve for the subsequent injection before the end of current determined for the electronically controlled spill valve is affected.

8. The fuel injector of claim 6, wherein the controller is further configured to:

receive an indication of a multi-shot injection event;

receive an indication of a desired pressure of a subsequent injection within the multi-shot injection event;

receive an indication of a desired quantity of the subsequent injection;

determine a start of current for the electronically controlled check valve relative to plunger displacement within the bore that results in the desired pressure of the subsequent injection;

determine an end of current for the electronically controlled check valve relative to plunger displacement within the bore that results in the desired quantity of fuel for the subsequent injection; and affect the start and end of current determined for the electronically controlled check valve for the subsequent injection before the end of current determined for the electronically controlled spill valve is affected.

9. The fuel injector of claim 2, wherein the controller is further configured to determine a time lag between the start of current for the electronically controlled spill and check valves and movement of elements associated with the electronically controlled spill and check valves.

10. A method of operating a fuel injector for an internal combustion engine having a crankshaft, the method comprising:

cammingly driving a plunger within a bore to pressurize fuel;

directing the pressurized fuel to at least one orifice of a nozzle member and to the base end of a valve needle disposed within the nozzle member;

receiving an indication of a desired start of injection timing relative to an angular position of the crankshaft, and a desired injection quantity; and electronically moving a check valve to drain the pressurized fuel from the base end of the valve needle to allow the pressurized fuel to flow through the at least one orifice at the desired start of injection timing in the amount of the desired injection quantity, wherein moving includes:

determining a start of current for the electronically controlled check valve relative to plunger displacement within the bore that results in the desired start of injection timing;

determining an end of current for the electronically controlled check valve relative to plunger displacement within the bore that results in the desired injection quantity; and affecting the determined start and end of current for the electronically controlled check valve.

11. The method of claim 10, further including moving an electronically controlled spill valve associated with the bore to selectively connect the bore to a drain, wherein moving includes:

receiving an indication of a desired start of injection pressure;

determining a start of current for the electronically controlled spill valve based on the desired start of injection pressure, the desired injection timing, and plunger displacement within the bore; and initiating the start of current determined for the electronically controlled spill valve.

12. The method of claim 11, further including initiating the start of current determined for the electronically controlled spill valve before initiating the start of current determined for the electronically controlled check valve.

13. The method of claim 11, further including:

receiving an indication of a desired end of injection pressure;

determining an end of current for the electronically controlled spill valve based on the determined end of current for the electronically controlled check valve and the desired end of injection pressure; and affecting the end of current determined for the electronically controlled spill valve.

14. The method of claim 13, further including affecting the end of current determined for the electronically controlled spill valve before affecting the end of current determined for the electronically controlled check valve.

15. The method of claim 11, further including affecting the end of current for the electronically controlled spill valve substantially immediately following the affecting of the end of current determined for the electronically controlled check valve.

16. The method of claim 15, further including:

receive an indication of a multi-shot injection event;

receiving an indication of a desired timing of a subsequent injection within the multi-shot injection event;

receiving an indication of a desired quantity of the subsequent injection;

determining a start of current for the electronically controlled check valve relative to plunger displacement within the bore that results in the desired start of injection timing of the subsequent injection;

determining an end of current for the electronically controlled check valve relative to plunger displacement within the bore that results in the desired quantity of the subsequent injection; and affecting the start and end of current determined for the electronically controlled check valve for the subsequent injection before the end of current determined for the electronically controlled spill valve is affected.

17. The method of claim 15, further including:

receiving an indication of a multi-shot injection event;

receiving an indication of a desired pressure of a subsequent injection within the multi-shot injection event;

receiving an indication of a desired quantity of the subsequent injection;

determining a start of current for the electronically controlled check valve relative to plunger displacement within the bore that results in the desired pressure of the subsequent injection;

determining an end of current for the electronically controlled check valve relative to plunger displacement within the bore that results in the desired quantity of the subsequent injection; and affecting the start and end of current determined for the electronically controlled check valve for the subsequent injection before the end of current determined for the electronically controlled spill valve is affected.

18. The method of claim 11, further including determining a time lag between the start of current for the electronically controlled spill and check valves and movement of elements associated with the electronically controlled spill and check valves.

19. An internal combustion engine, comprising:

an engine block having at least one combustion chamber;

a crankshaft rotatingly disposed within the engine block; and a fuel system including:

a fuel injector configured to inject a desired quantity of pressurized fuel into the combustion chamber at a desired timing, the fuel injector including:

plunger reciprocatingly disposed within a bore to pressurize fuel within the bore;

a nozzle member having a tip end with at least one orifice;

a valve needle having a base end and tip end, being disposed within the nozzle member, and movable against a spring bias to allow a flow of pressurized fuel through the at least one orifice;

an electronically controlled check valve in fluid communication with the bore and the base end of the valve needle, the electronically controlled check valve movable between a first position at which the bore is fluidly communicated with the base end of the valve needle, and a second position at which the base end of the valve needle is fluidly communicated with a drain;

a cam mechanism operably connected to the crankshaft and configured to drive the plunger;

a sensor configured to sense an angular position of the crankshaft; and a controller in communication with the electronically controlled check valve and the sensor, the controller configured to:

receive an indication of a desired start of injection timing relative to the angular position of the crankshaft, and a desired injection quantity;

determine a displacement of the plunger based on the sensed angular position of the crankshaft;

determine a start of current for the electronically controlled check valve relative to plunger displacement within the bore that results in the desired start of injection timing;

determine an end of current for the electronically controlled check valve relative to plunger displacement within the bore that results in the desired injection quantity; and affect the determined start and end of current for the electronically controlled check valve.

20. The internal combustion engine of claim 19, further including an electronically controlled spill valve associated with the bore and movable to selectively connect the bore to a drain, wherein the controller is further configured to:

receive an indication of a desired start of injection pressure;

determine a start of current for the electronically controlled spill valve based on the desired start of injection pressure, the desired start of injection timing, and plunger displacement within the bore; and initiate the start of current determined for the electronically controlled spill valve.

21. The internal combustion engine of claim 20, wherein the controller is further configured to:

receive an indication of a desired end of injection pressure;

determine an end of current for the electronically controlled spill valve based on the determined end of current for the electronically controlled check valve and the desired end of injection pressure; and affect the end of current determined for the electronically controlled spill valve.

22. The internal combustion engine of claim 21, wherein the controller is further configured to:

receive an indication of a multi-shot injection event;

receive an indication of one of a desired start of injection timing and a desired pressure of a subsequent injection within the multi-shot injection event;

receive an indication of a desired quantity of the subsequent injection;

determine a start of current for the electronically controlled check valve relative to plunger displacement within the bore that results in the one of a desired start of injection timing and a desired pressure of the subsequent injection;

determine an end of current for the electronically controlled check valve relative to plunger displacement within the bore that results in the desired quantity of the subsequent injection; and affect the start and end of current determined for the electronically controlled check valve for the subsequent injection before the end of current determined for the electronically controlled spill valve is affected.

* * * * *

UNITED STATES PATENT AND TRADEMARK OFFICE

CERTIFICATE OF CORRECTION

PATENT NO. : 7,255,091 B2
APPLICATION NO. : 11/139685
DATED : August 14, 2007
INVENTOR(S) : Barnes et al.

It is certified that error appears in the above-identified patent and that said Letters Patent is hereby corrected as shown below:

In Column 6, Line 16, delete "10a" and insert -- 110a --, therefor.

Signed and Sealed this

Twenty-fourth Day of June, 2008

JON W. DUDAS
*Director of the United States Patent and Trademark Office*